US006584926B1

(12) United States Patent
Schmitt et al.

(10) Patent No.: US 6,584,926 B1
(45) Date of Patent: Jul. 1, 2003

(54) T-TOP APPARATUS WITH BUILT-IN SEAT FOR BOATS

(75) Inventors: Ronald T. Schmitt, Lancaster, PA (US); William C. Becker, Northport, FL (US)

(73) Assignee: G. G. Schmitt & Sons, Inc., Lancaster, PA (US)

( * ) Notice: Subject to any disclaimer, the term of this patent is extended or adjusted under 35 U.S.C. 154(b) by 0 days.

(21) Appl. No.: 10/087,334

(22) Filed: Mar. 1, 2002

(51) Int. Cl.[7] ..... B63B 17/00
(52) U.S. Cl. ..... 114/361; 114/363; 135/88.01
(58) Field of Search ..... 114/343, 363, 114/201 R, 361; 297/184.15; 135/90, 88.01

(56) References Cited

U.S. PATENT DOCUMENTS 3,243,230 A * 3/1966 Otto ..... 297/184.15
4,846,524 A * 7/1989 Gerber ..... 135/88.09
4,924,896 A * 5/1990 Carter ..... 135/90
5,080,432 A * 1/1992 Connell ..... 297/184.15
5,102,190 A * 4/1992 Akin et al. ..... 297/184.15
5,769,022 A * 6/1998 Luxford ..... 114/361
5,918,613 A * 7/1999 Larson ..... 135/88.01
5,967,601 A * 10/1999 Gillins ..... 297/184.15
5,983,824 A * 11/1999 Hernandez ..... 114/361
6,042,170 A * 3/2000 Yamaoka et al. ..... 296/76
6,223,680 B1 * 5/2001 Frink et al. ..... 114/361
6,263,825 B1 * 7/2001 Davidson ..... 114/343
6,349,666 B1 * 2/2002 Hastings ..... 114/361
6,375,522 B1 * 4/2002 Bellens et al. ..... 440/40
6,439,150 B1 * 8/2002 Murphy et al. ..... 114/361

* cited by examiner

*Primary Examiner*—S. Joseph Morano
*Assistant Examiner*—Lars A. Olson
(74) *Attorney, Agent, or Firm*—Miller Law Group, PLLC

(57) ABSTRACT

A T-top apparatus for a boat is described in which the rigid framework of the T-top apparatus supports a built-in boat helm seat, seat backrest and other optional attachments. The rigid framework can be secured by bolts to the boat deck only, providing a convenient and effective manner in which to mount the T-top apparatus without requiring additional mounting hardware to fix the T-top structure to either the seat or center console helm. In an optional configuration, the T-top apparatus is formed in two sections with an upper section bearing the canvas roof and the lower section having the boat helm seat mounted therein. The upper section could be pivotally mounted to the lower section to permit the upper section to be pivotally lowered into a lowered configuration in which the overall height of the T-top apparatus is substantially at the same height of the boat helm seat. The upper section could be easily returned to the operating position simply by pivoting the upper section back on top of the lower section. A fastening or locking mechanism would fix the upper and lower sections to resist wind forces and other forces urging the upper section toward the lowered position.

17 Claims, 5 Drawing Sheets

T-TOP APPARATUS WITH BUILT-IN SEAT FOR BOATS

BACKGROUND OF THE INVENTION

This invention relates generally to a T-top for use on boats and, more particularly, to a T-top apparatus having a built-in seat for mounting directly to the deck of a boat.

T-tops are a specialized roof apparatus added to boats not otherwise having a roof over the center console helm seat, such as medium-sized fishing boats, for example. Conventional T-top construction includes a rigid framework that supports a roof, made from canvas or other composite material, over the top of the center console helm seat, with the framework being attached to either the boat deck, the center console helm, or a combination of both. This makes the conventional T-top devices special and custom to each particular application due to the varied sizes and shapes of the center consoles. Conventional T-top devices do not include a built-in seat or seat backrest, as such devices are typically supplemental to the boat seat helm and center helm console. When the boat encounters overhead clearance problems, such as could be encountered on the sea or on transport over the highway, the T-top, as the highest structure of the boat, will be the limiting factor in passing under low overhead obstacles.

It would, therefore, be desirable to provide a T-top apparatus that solves the aforementioned problems and provides a improved T-top apparatus that will have a seat and seat built into the framework. It would be desirable for a T-top apparatus to be adaptable to many models by incorporating a universal deck or floor mounting so that mounting the T-top apparatus would not be affected by the size or shape of the center console helm. It would also be desirable to provide a T-top apparatus that incorporated a seat and back rest, as well as an optional foot rest. Other optional enhancements to solve problems associated with conventional T-top devices would include a breakaway or a fold-down mechanism to facilitate reduced height clearance requirements at sea or on roadways to clear overhead obstacles. It would also be desirable to provide a T-top design that would lend itself to the retail aftermarket as a boat owner could add such a feature to his boat without requiring any custom design or special fabrication.

SUMMARY OF THE INVENTION

It is an object of this invention to provide a T-top apparatus with a built-in boat helm seat which can be quickly and easily moved attached to the deck of the boat independently of the center console helm.

It is another object of this invention to provide a T-top apparatus in which the framework is formed in two section that are pivotally connected to one another to permit a lowering of the roof to permit passage beneath low-hanging fixed structures.

It is a feature of this invention that the T-top apparatus has a boat helm seat and seat backrest built-in to the framework of the apparatus, and is capable of accommodating an optional footrest or other related devices.

It is an advantage of this invention that the T-top apparatus with built-in seat and seat back can be attached directly to the boat deck.

It is another advantage of this invention that the T-top apparatus with built-in seat and seat backrest can be mounted on the boat without requiring custom modification of the T-top apparatus to accommodate the varied sizes and shapes of center console helms.

It is still another object of this invention to provide a T-top apparatus that can be lowered to reduce the overall height of the boat when passing beneath low hanging fixed structures.

It is still another feature of this invention that the T-top apparatus can be formed in two sections with the upper section being pivotally mounted to the lower section to permit movement of the upper section relative to the lower section.

It is yet another feature of this invention that the upper section of the T-top apparatus can be pivotally lowered to reduce the overall height of the boat to facilitate passage thereof beneath low hanging fixed structures.

It is still another advantage of this invention that the T-top apparatus can be lowered quickly and easily to reduce the overall height of the boat.

It is yet another advantage of this invention that the T-top apparatus can be returned to the full operating height with little effort to return the T-top apparatus to an operating position.

It is a further feature of this invention to provide a latching mechanism that will resist wind forces on the T-top apparatus urging the upper section to pivot into the lowered configuration while the T-top apparatus is in an operating configuration.

It is yet another object of this invention to provide a T-top apparatus containing a built-in seat and which is pivotally movable to reduce the overall height of the boat, which is durable in construction, inexpensive of manufacture, carefree of maintenance, facile in assemblage, and simple and effective in use.

These and other objects, features and advantages are accomplished according to the instant invention by providing a T-top apparatus for a boat in which the rigid framework of the T-top apparatus supports a built-in boat helm seat, seat backrest and other optional attachments. The rigid framework can be secured by bolts to the boat deck only, providing a convenient and effective manner in which to mount the T-top apparatus without requiring additional mounting hardware to fix the T-top structure to either the seat or center console helm. In an optional configuration, the T-top apparatus is formed in two sections with an upper section bearing the canvas roof and the lower section having the boat helm seat mounted therein. The upper section could be pivotally mounted to the lower section to permit the upper section to be pivotally lowered into a lowered configuration in which the overall height of the T-top apparatus is substantially at the same height of the boat helm seat. The upper section could be easily returned to the operating position simply by pivoting the upper section back on top of the lower section. A fastening or locking mechanism would fix the upper and lower sections to resist wind forces and other forces urging the upper section toward the lowered position.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
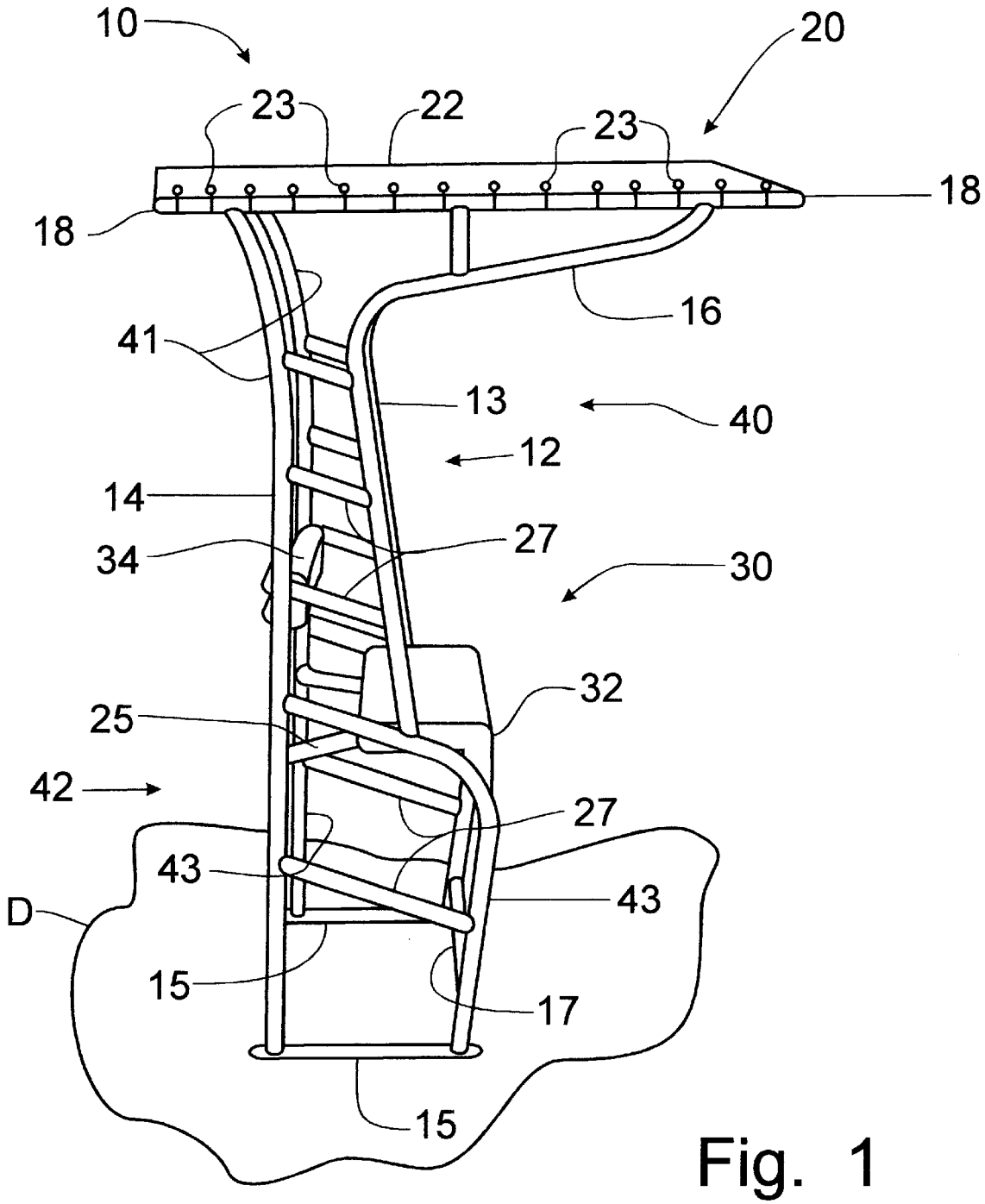
FIG. 1 is an upper, right side perspective view of a T-top apparatus incorporating the principles of the instant invention with the boat helm seat and seat back built into the frameworks.
Figure 2:
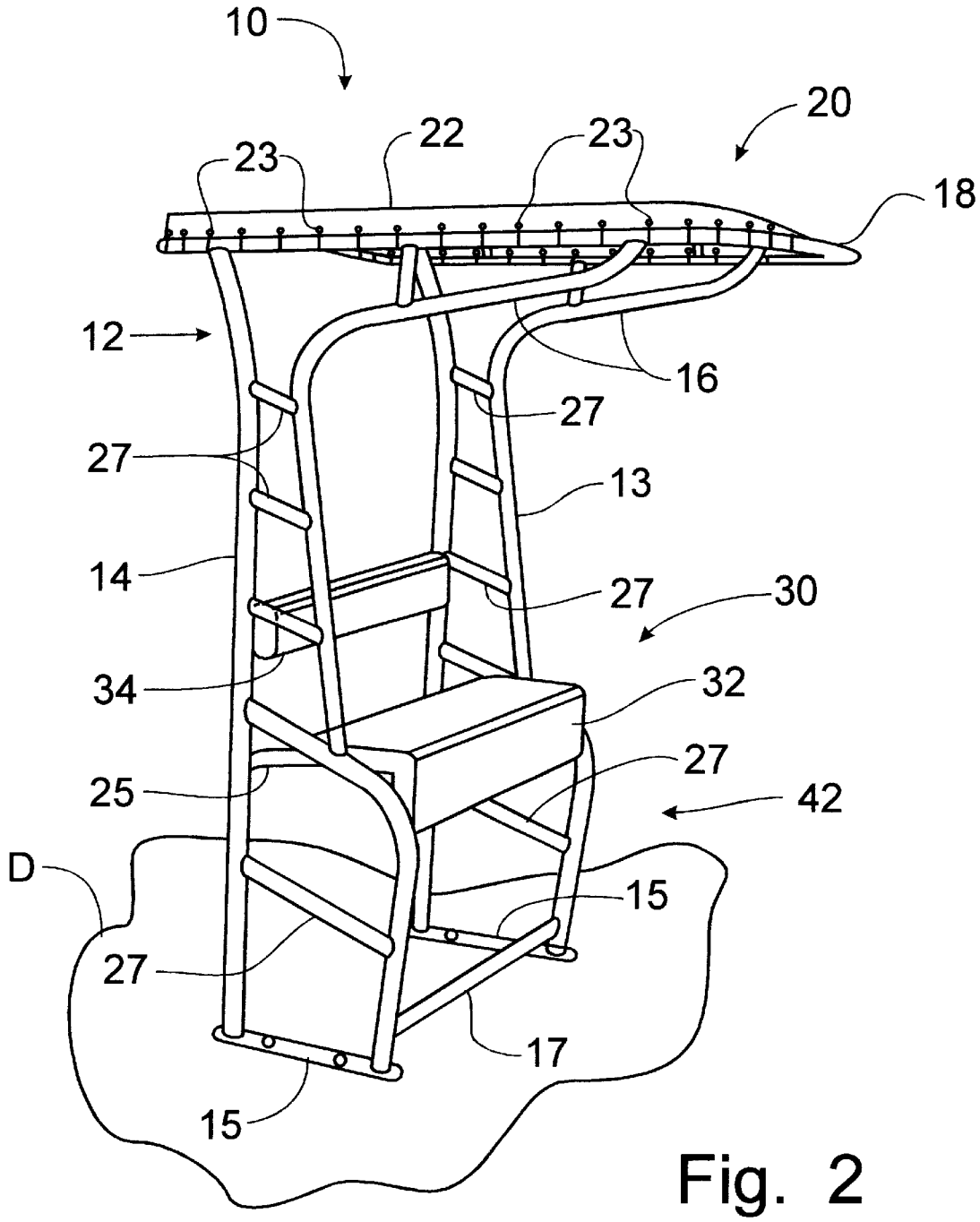
FIG. 2 is an upper, right front perspective view of the T-top apparatus shown in FIG. 1.

Referring now to FIGS. 1 and 2, a T-top apparatus having a built-in boat helm seat, which can be referred to as a "T-Seat", incorporating the principles of the instant invention, can best be seen. All references to left, right, front and rear are determined by standing behind the T-Seat apparatus 10 adjacent the seat back 34 and facing forwardly toward the seat portion 32.

The T-top apparatus 10 is formed from a frame 12 preferably, but not limited to aluminum pipe or stainless steel tubing cut and welded into a configuration including left and right identical halves 13, 14. The bottom portion of each laterally spaced half 13, 14 of the frame 12 is formed with a mounting plate 15 having a flat surface adapted for attachment to the conventional deck D of a boat.

The top of each laterally spaced half 13, 14 of the frame 12 is formed in a fore-and-aft extending roof support portion 16 such that the fore-and-aft length of the roof support portion 16 is greater than the mounting plates 15. The two halves 13, 14 of the frame 12 are joined together by transversely oriented connector pieces, such as the cross frame base member 17 and the front and rear roof frame members 18 to form a framework. The roof support portions 16 connected with the front and rear roof frame members 18 are covered with a roof member 22, typically in the form of a canvas top, or a top constructed of a composite material, stretched between the roof support portions 16 and the front and rear roof frame members 18 to form the T-top roof 20. As depicted in FIGS. 1 and 2, the canvas or composite top is preferably tied to the roof support portions and the front and rear roof frame members by a tie device that threads through eyelets 23 formed in the canvas or composite top 22 to facilitate engagement between the canvas top 22 and the framework 16, 18 of the roof portion of the T-top roof member 20.

Spanning substantially between the two laterally spaced halves 13, 14 and between the roof 20, a boat helm seat 30 is supported on seat support members 25 for use in a variety of different uses. While the conventional utilization for T-top devices 10 is in conjunction with boat helm seats, one skilled in the art will readily recognize that the T-top apparatus 10 can be used for other seat arrangements. The boat helm seat 30 includes a seat portion 32 positioned between the left and right halves 13, 14 at an elevation corresponding to a normal seating position. The boat helm seat 30 also includes a seat black portion 34 that also spans substantially between the left and right halves 13, 14 at a location higher and rearward of the seat portion 32 to provide support for the operator's back. The roof member 20 of the T-top apparatus 10 is sufficiently large enough to extend both forwardly and rearwardly of the seat portion 32 to provide adequate shade for the boat operator sitting in the seat portion 32. An optional attachment of a footrest to the frame 12 below the seat portion 32 and projecting forwardly thereof could also be added.

Such a T-Seat apparatus 10 is thus fixed in a universal manner directly to the deck D of the boat and incorporates a boat helm seat 30 directly into the, T-Seat apparatus 10 so that the mounting of the T-Seat apparatus 10 directly to the boat deck D provides a built-in seat for the boat helm seat 20 in an aesthetically pleasing appearance. Furthermore, the stability of the entire T-Seat assembly 10 is enhanced as the frame 12 will be bolted directly to the deck of the boat, while the seat back 34 and seat 32 not only enhance the structural stability of the T-Seat apparatus 10, but provide a functional utilization as well as a boat helm seat 30. There is no need to custom mount the frame 16, 18 for the roof 20 to the boat helm seat or to the center console helm, as is known with respect to conventional T-top devices.

The mounting of a T-Seat apparatus 10 directly to the deck D provides the significant advantage of having a universal T-top apparatus 10 that will adapt to a universal mounting to substantially any boat. The customization required for the fitting of conventional T-top devices to the variable shapes and sizes of the center console helm (not shown) or the existing boat helm seat has been eliminated in favor of the universal T-Seat apparatus 10 having a built-in helm seat 30 and seat backrest 32. Furthermore, the universal mounting ability of the T-top apparatus 10 incorporating the present invention permits the T-Seat apparatus 10 to be sold as an after-market attachment that can be purchased by existing boat owners for mounting on his own boat without requiring customization services as has been known in the art.

Figure 3:
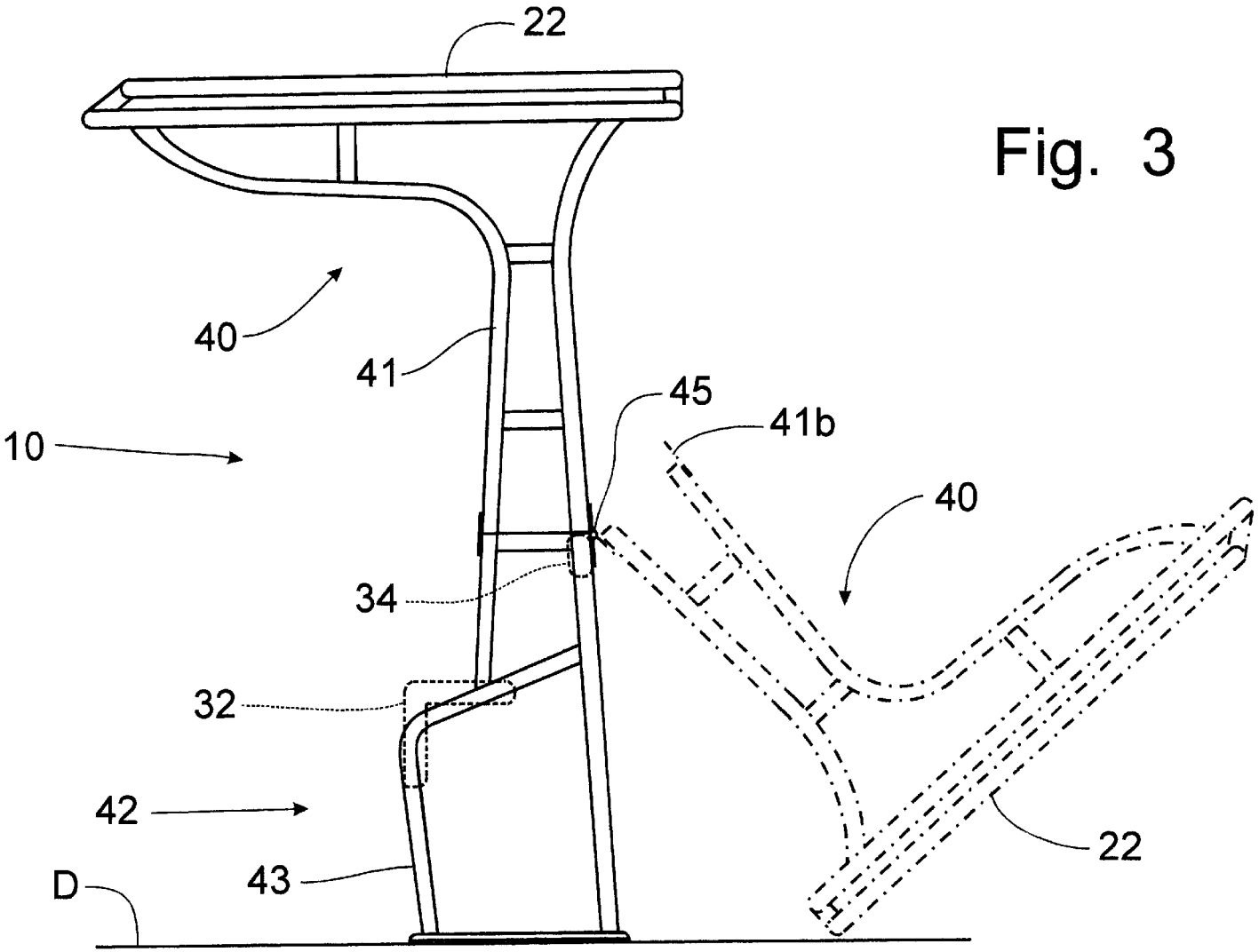
FIG. 3 is schematic side elevational view of the T-top frame structure showing an alternative configuration in which an upper section of the apparatus is pivotally connected to a lower section of the apparatus to provide a T-top apparatus in which the overall height can be quickly and easily configured between an operating position shown in solid lines to a lowered position shown in phantom, the seat and seat back are depicted in dashed lines.
Figure 4:
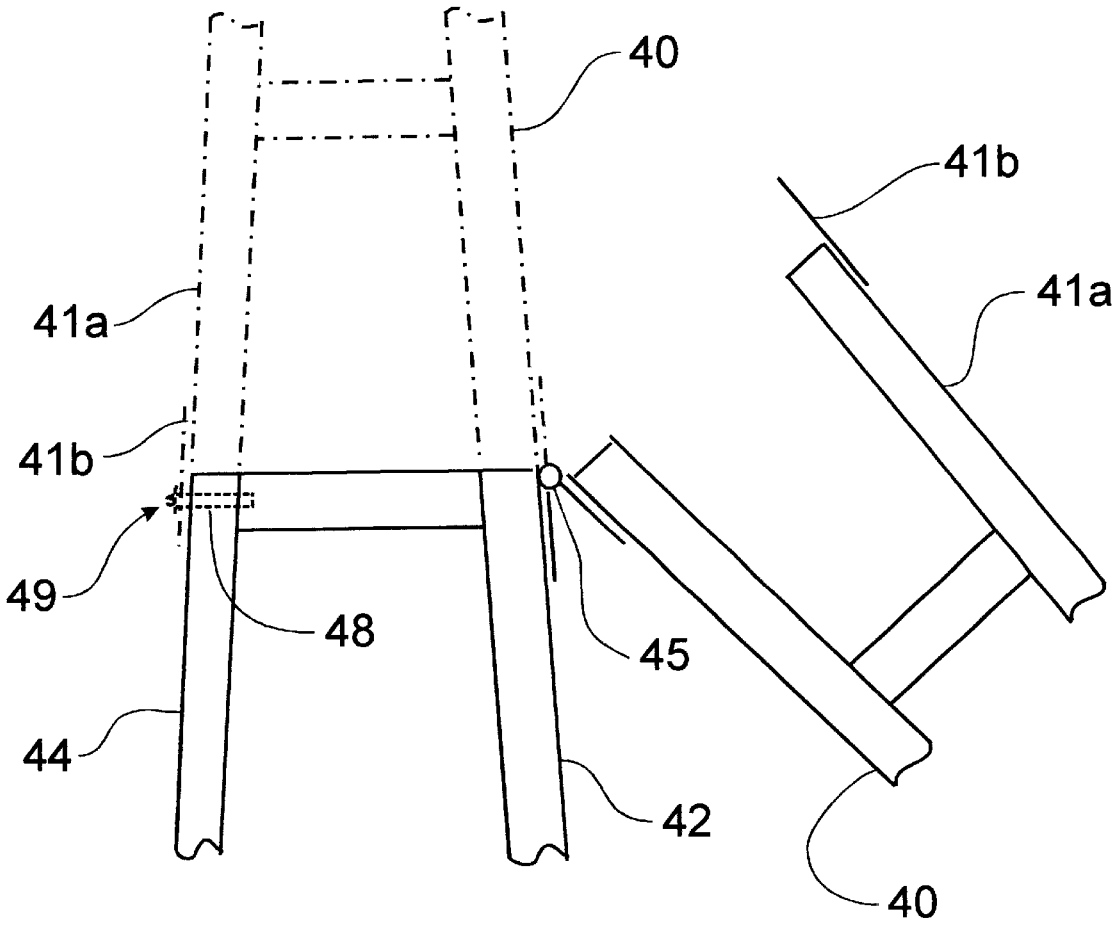
FIG. 4 is an enlarged side elevational view of the central portion of the frame sections shown in FIG. 3 with the lowered position shown in solid lines and the operating positions of the upper section being shown in phantom, a representative, latching device is shown dashed lines to fix the upper section to the lower section when in the raised operating position.

Referring now to FIGS. 3 and 4, one skilled in the art will recognize an alternative embodiment of the T-Seat apparatus 10 than is shown in FIGS. 1 and 2. The side frame members 27 are placed at generally horizontal and/or vertical orientations, as opposed to the upwardly, rearwardly sloped orientations shown in FIGS. 1 and 2, but otherwise are substantially the same as the configurations depicted in FIGS. 1 and 2. In the alternative embodiment shown in FIGS. 3 and 4, however, each laterally spaced side frame member 13, 14 is formed with an upper portion 41, joined by the roof member 22 to form the top portion 40 of the T-Seat apparatus 10. Each side frame member 13, 14 is also formed with a lower portion 43 joined together by the seat portion 32, the seat back portion 34, and the cross frame member 17 to form the bottom portion 42 of the T-Seat apparatus. As with the first embodiment of the invention shown in FIGS. 1 and 2, the lower portions 43 also includes the mounting plates 15 for attachment of the T-Seat apparatus 10 to the boat deck D by detachable fasteners.

Preferably, the upper portions 41 of the side frame halves 13, 14, are pivotally joined to the corresponding lower portions 43 in a manner that the top portion 40 of the T-Seat apparatus 10 is pivotally movable relative to the bottom portion 42 about a pivot axis defined at the rear of the frame 12, such as would be formed by the hinge members 45. A suitable latch mechanism 47 detachably connects the fronts frame member 41*a* of the upper portions 40 to the corresponding front frame member 44 of the lower portions 42 in a manner that the top portion 40 is immobile relative to the bottom portion 42 when the latch mechanism 47 is engaged. One such latch mechanism 47 could be a spring pin 48 or a click pin that can be inserted through an opening in a latch plate 41*b* depending downwardly from each front frame member 41*a* of the upper portions 41 and into an opening into the front frame member 44 of the lower portions 43. The pin mechanism 48 would remain in place until an external force is exerted on the pin 48 to cause it to be selectively disengaged from the front frame member 44, whereupon the top portion 40 would be free to rotate about the hinge members 45 to lower the roof member 22 toward the deck D.

In operation, whenever the overall height of the T-Seat apparatus 10 needs to be lowered to pass beneath some low-hanging fixed structure, such as a bridge or the like, the pin 48 is removed from engagement with the front frame members 41*a,* 44 of the respective upper and lower portions 41, 43 so that the top portion 40 with the roof member 22 can be manually pivoted about the hinge members 45 to a lowered inoperative position with the roof member 22 being positioned next to the deck D of the boat, thus reducing the height of the T-Seat apparatus 10 temporarily. Once the low-hanging obstruction has been cleared, the top portion 40 can be pivoted back into the normal operative position, shown in solid lines in FIG. 3, with the roof member 22 positioned above the seat portion 32. A re-engagement of the latch mechanism 47 secures the top portion 40 to the bottom portion 42 so that normal wind forces will not cause the roof member 22 to pivot about the hinge mechanism 45.

While pivotal connection of the top portion 40 to the bottom portion 42 is preferable in the manner described above, other means for movably connecting the top and bottom portions 40, 42 can be utilized. For example, placing the hinge mechanism 45 to interconnect the front frame members 41*a,* 44, instead of at the rear of the frame 12 as shown in FIGS. 3 and 4, would allow the top portion 40 to better resist wind forces during normal operation as the wind resistance would not urge the top portion 40 into the direction of its pivotal movement. In such a configuration, the latch mechanism 47 would have very little stress on it, as compared to the configuration shown in FIGS. 3 and 4. Such an alternative configuration, however, could only be used when the boat helm (not shown) is configured to permit the roof member 22 to be lowered to the deck D without causing interference thereof. Accordingly, the configuration shown in FIGS. 3 and 4 are believed to be the most versatile with respect to application to differently manufactured boats.

Figure 5:
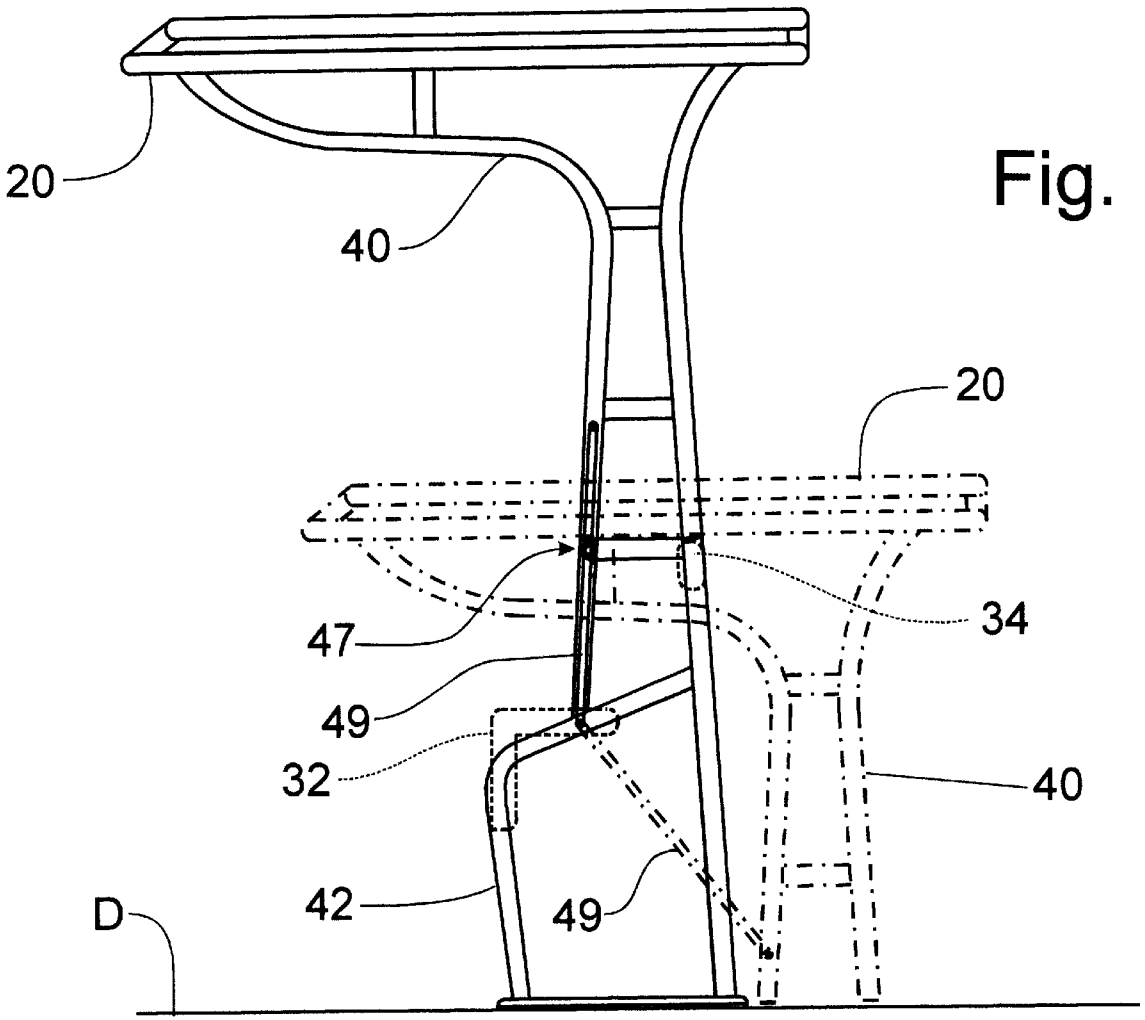
FIG. 5 is schematic side elevational view of a second alternative configuration in which the upper section of the apparatus is connected to a linkage that permits substantially parallel movement of the upper section when lowered onto the lower section.

Alternatively, the top portion 40 could be connected to a breakaway linkage that interconnects the top and bottom portions 40, 42 to allow the top portion 40 to lower into a parallel orientation, as is depicted in FIG. 5. The top portion 40 is connected to breakaway links 49 preferably positioned on the outside of the side frame members 13, 14 that interconnect with the bottom portion 42. A latch mechanism 47, such as a click pin 48, can interconnect one of the links 49 and the adjacent side frame member 13, 14 on either the top or bottom portions 40, 42, or alternatively between corresponding members of the top and bottom portions 40, 42, as described above with respect to FIGS. 3 and 4. Preferably, two such latch mechanisms 47 could be disposed, respectively, to secure each of the side frame members 13, 14 for greater stability of the top portion 40 during normal operation.

When being lowered, as is depicted in phantom in FIG. 5, the roof member 22 lowers in a parallel orientation from its normal operation to generally collapse the roof member 22 onto the bottom portion 42. Of course, in such a configuration, the top portion 40 would necessarily have a wider stance than the bottom portion 42 so that there would not be any interference between the top and bottom portions 40, 42 when being moved into the lowered inoperative position. The amount of vertical movement permitted to the top portion 40 relative to the bottom portion 42 would be a function of the length of the links 49 and the respective orientation thereof on the top and bottom portions 40, 42.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A T-top apparatus comprising:

a rigid frame having a left side member and a right side member divided between:

a lower portion including a mounting plate for attachment thereof to a boat deck; and an upper portion supporting a roof member positioned at an elevated position;

a seat member supported on said lower portion interconnecting said left side frame member and said right side frame member; and a seat back member supported on said lower portion interconnecting said left and right side frame members at a position above said seat member.

2. The T-top apparatus of claim 1 wherein said roof member interconnects said left and right side frame members.

3. The T-top apparatus of claim 2 wherein said upper portions and said roof member form a top portion of said T-top apparatus, said lower portions with said interconnecting seat member and seat back member forming a bottom portion of said T-top apparatus, said top portion being movably mounted on said bottom portion to selectively permit said roof member to be vertically lowered.

4. The T-top apparatus of claim 3 wherein said top portion is pivotally connected to said bottom portion so that said top portion is pivotally movable to cause said roof member to be lowered toward the boat deck.

5. The T-top apparatus of claim 4 further comprising a latch mechanism interengagable between said top portion and said bottom portion to restrict pivotal movement of said top portion relative to said bottom portion.

6. In a T-top apparatus for mounting on a boat to provide a detachable roof structure for said boat, the T-top apparatus including a frame having left and right frame members extending upwardly to support an elevated roof member, the improvement comprising:

said frame supporting a seat member extending between said left and right frame members beneath said roof member; and said left and right frame members including universal mounting plates for attaching said left and right frame members, respectively, to a deck of said boat.

7. The T-top apparatus of claim 6 wherein said frame also supports a seat back member extending between said left and right frame members positioned above said seat member and beneath said roof member.

8. The T-top apparatus of claim 7 wherein each of said left and right frame members include an upper portion supporting said roof member and a lower portion connected to said seat member and said seat back member, said upper portions and said roof member forming a top portion of said T-top apparatus, said lower portions, said seat member and said seat back member forming a bottom portion of said T-top apparatus, said top portion being supported on said bottom portion for movement relative thereto.

9. The T-top apparatus of claim 8 wherein said top portion is pivotally attached to said bottom portion so that said top portion is pivotally movable to effect a lowering of said roof member to a lowered position from said elevated position.

10. The T-top apparatus of claim 9 wherein said top portion is connected to said bottom portion by a hinge defining a generally horizontal pivot axis for movement of said top portion relative to said bottom portion, a latch mechanism interconnects said top and bottom portions to restrict pivotal movement of said top portion.

11. The T-top apparatus of claim 10 wherein said hinge mechanism is positioned rearwardly of said side frame members, said latch mechanism being engagable with front frame members of said side frame members.

12. In a frame for a T-top apparatus to provide a detachable roof structure for a boat, said frame including left and right frame members extending upwardly to support a roof member in an elevated position, the improvement comprising:

each of said left and right frame members include an upper portion supporting said roof member and a lower portion, said upper portions and said roof member forming a top portion of said T-top apparatus, said lower portions being interconnected to form a bottom portion of said T-top apparatus, said top portion being supported on said bottom portion for movement relative thereto for lowering said roof member from said elevated position to a lowered position, said top portion being connected to said bottom portion by a hinge defining a generally horizontal pivot axis for movement of said top portion relative to said bottom portion, a latch mechanism interconnecting said top and bottom portions to restrict pivotal movement of said top portion.

13. The T-top apparatus frame of claim 12 wherein said hinge mechanism is positioned rearwardly of said side frame members, said latch mechanism being engagable with front frame members of said side frame members.

14. In a frame for a T-top apparatus that can be mounted on a boat to provide a roof structure for said boat, said frame including left and right frame members extending upwardly to support a roof member in an elevated position, the improvement comprising:

each of said left and right frame members include an upper portion supporting said roof member and a lower portion, said upper portions and said roof member forming a top portion of said frame, said lower portions being interconnected to form a bottom portion of said frame, said top portion being supported on said bottom portion for movement relative thereto to lower said roof member from said elevated position to a lowered position; and said left and right frame members being adapted to support a seat member extending therebetween beneath said roof member, and to support a seat back member extending therebetween above said seat member.

15. The T-top apparatus frame of claim 14 wherein said left and right frame members include a mounting plate for attachment of said T-top apparatus directly to a deck of said boat.

16. The T-top apparatus frame of claim 14 wherein said top portion is connected to said bottom portion by a hinge defining a generally horizontal pivot axis for movement of said top portion relative to said bottom portion, said frame including a latch mechanism interconnecting said top and bottom portions to restrict pivotal movement of said top portion.

17. The T-top apparatus frame of claim 16 wherein said hinge mechanism is positioned rearwardly of said side frame members, said latch mechanism being engagable with front frame members of said side frame members.

* * * * *